US011926937B2

(12) United States Patent
Blythe

(10) Patent No.: US 11,926,937 B2
(45) Date of Patent: Mar. 12, 2024

(54) TURNED WELT WITH MOISTURE MANAGEMENT

(71) Applicant: DRYMAX TECHNOLOGIES, INC., Paso Robles, CA (US)

(72) Inventor: William A. Blythe, Atascadero, CA (US)

( * ) Notice: Subject to any disclaimer, the term of this patent is extended or adjusted under 35 U.S.C. 154(b) by 322 days.

(21) Appl. No.: 17/194,136

(22) Filed: Mar. 5, 2021

(65) Prior Publication Data

US 2021/0277551 A1 Sep. 9, 2021

Related U.S. Application Data

(60) Provisional application No. 62/986,996, filed on Mar. 9, 2020.

(51) Int. Cl.

| | |
|---|---|
| ***D04B 1/14*** | (2006.01) |
| ***D04B 1/10*** | (2006.01) |
| ***D04B 1/24*** | (2006.01) |
| ***D04B 9/54*** | (2006.01) |

(52) U.S. Cl.

CPC ..... *D04B 1/14* (2013.01); *D04B 1/106* (2013.01); *D04B 1/24* (2013.01); *D04B 9/54* (2013.01); *D10B 2401/021* (2013.01); *D10B 2401/022* (2013.01); *D10B 2501/06* (2013.01)

(58) Field of Classification Search

CPC ..... D04B 1/106; D04B 9/54; D04B 11/32
USPC ..... 2/165
See application file for complete search history.

(56) References Cited

U.S. PATENT DOCUMENTS

| | | | | |
|---|---|---|---|---|
| 2,720,097 | A * | 10/1955 | De Mond | A61F 13/08 66/182 |
| 3,250,095 | A * | 5/1966 | Bird | D04B 1/26 66/178 R |
| 4,571,960 | A * | 2/1986 | Hursh | A41B 11/005 66/196 |
| 5,291,617 | A | 3/1994 | Moretz et al. | |
| 5,297,296 | A | 3/1994 | Moretz et al. | |
| 6,341,505 | B1 | 1/2002 | Dahlgren | |
| 6,572,437 | B1 * | 6/2003 | Waitz | A41C 3/00 450/1 |
| 9,867,411 | B2 * | 1/2018 | Gallagher | A41D 19/001 |
| 11,464,265 | B2 * | 10/2022 | Blythe | D04B 1/12 |
| 2003/0182922 | A1 | 10/2003 | Peters et al. | |
| 2007/0034278 | A1 | 2/2007 | Li et al. | |
| 2008/0289090 | A1 | 11/2008 | Brier | |

(Continued)

FOREIGN PATENT DOCUMENTS

| | | | | |
|---|---|---|---|---|
| CH | 317081 | A * | 11/1956 | D04B 1/02 |
| JP | 06128848 | A * | 5/1994 | D04B 1/106 |

*Primary Examiner* — Grace Huang

(74) *Attorney, Agent, or Firm* — Christopher J. Knors; Moore & Van Allen PLLC

(57) ABSTRACT

A cuff, a collar, a welt, a hem, or a waistband structure having moisture management functionality utilizing hydrophilic and hydrophobic knitted yarns, and a method of manufacturing such a cuff or collar are described. The cuff or collar is knit using a patterning mechanism to form a tubular body having one or more individual courses, each of which have adjacent wales the tubular body terminating in a turned welt having moisture management functionality where the hydrophobic/hydrophilic arrangement of individual courses of the tubular body is generally maintained in the turned welt.

14 Claims, 4 Drawing Sheets

(56) References Cited

U.S. PATENT DOCUMENTS

2012/0324961 A1* 12/2012 Clemendot ..... D04B 1/106
66/178 R
2020/0308738 A1* 10/2020 Lineberry ..... A41B 11/121

* cited by examiner

TURNED WELT WITH MOISTURE MANAGEMENT

CROSS-REFERENCE TO RELATED APPLICATIONS

This application claims the benefit of U.S. Provisional Application No. 62/986,996 filed on Mar. 9, 2020, the entirety of which is incorporated herein by reference.

TECHNICAL FIELD

A cuff or collar structure having moisture management functionality utilizing hydrophilic and hydrophobic knitted yarns, and a method of manufacturing such a cuff or collar are described. The cuff or collar is knit using a patterning mechanism to form a tubular body having one or more individual courses, each of which have adjacent wales the tubular body comprising a turned welt having moisture management functionality.

BACKGROUND

During normal or athletic activity, fabric which contacts the skin surface of the wearer inevitably collects perspiration and body oils, leading to the possibility of rashes and other skin conditions as well as general discomfort. Conventional cuff or collar/hem of an article of clothing may include a knitted or woven tubular fabric structure of a desired length with a folded-over welt at one end of the tubular fabric structure, for example, consisting of a skin-contacting hydrophobic yarn and an outward-facing hydrophilic yarn intended to absorb and/or collect perspiration by the hydrophobic yarn where, in the turned-welt, the structural orientation of the skin-contacting hydrophobic yarn and the outward-facing hydrophilic yarn is reversed, albeit, for a short distance at the distal edge of the cuff or collar/hem. This reversing of the skin-contacting hydrophobic yarn and the outward-facing hydrophilic yarn results in the wicked moisture/perspiration being presented to the hydrophilic yarns at skin-side of the turned welt presenting the hydrophilic yarn to the skin of the wearer, resulting in a wet sensation and/or discomfort in the cuff, collar, or hem as the hydrophilic yarn receives the wicked moisture from hydrophobic yarn. Thus, the conventional turned welt lacks the ability to prevent or eliminate discomfort and/or skin-related effects caused by the constant contact of the moisture/perspiration contained in the turned welt and the skin-contacting hydrophilic yarns with the skin of the wearer during use. Furthermore, when the skin-contacting hydrophobic yarn comprises metal or metal salts/metal cations, the beneficial effects of such metal-containing hydrophobic yarn is reduced in this area of the welt.

SUMMARY

In one example, cuff or collar is provided, the cuff or collar comprising a tubular body having an opening; and a turned welt being in surrounding relation to the opening, the turned welt integral with the tubular body; the turned welt having skin facing surface configured for engagement with skin of a wearer and an outside non-skin facing surface; and the turned welt being of a knitted construction comprising a hydrophobic yarn predominantly presented on the inside surface and a hydrophilic yarn predominantly presented on the outside surface and wherein the tubular body is of a knitted construction comprising a hydrophobic yarn predominantly presented on an inside surface corresponding to the skin facing surface of the turned welt and an outer surface corresponding to the non-skin facing surface of the turned welt.

In one example, the turned welt is integral with the tubular body. In another example, alone or in combination with any of the previous examples, the turned welt comprises yarn comprising metal-containing fiber comprising copper or silver metal, oxides, or salts.

In another example, alone or in combination with any of the previous examples, the turned welt of the cuff or collar includes an elastic make up yarn. In another example, alone or in combination with any of the previous examples, the skin-facing surface is integral with and adjacent to a moisture absorbing yarn adjacent the outer surface.

In one example, the skin-facing surface is a hydrophobic yarn integral with and directly adjacent either a moisture wicking yarn, moisture absorbing yarn, or combinations of a moisture wicking yarn and moisture absorbing yarn where the moisture absorbing yarn is predominantly present in the outer non-skin facing surface. In another example, alone or in combination with any of the previous examples, the skin-facing surface is predominantly a hydrophobic yarn and the outer non-skin facing surface is predominantly a moisture absorbing yarn.

In another example, alone or in combination with any of the previous examples, the skin-contacting surface presents yarn with metal-containing fiber.

In another example, a method of managing moisture transport in a cuff or collar of an article of clothing is provided, the method comprising: providing an article comprising a collar or cuff with a turned welt; the turned welt integral with a tubular body; the turned welt having skin facing surface configured for engagement with skin of a wearer and an outside non-skin facing surface; and the turned welt being of a knitted construction comprising a hydrophobic yarn predominantly presented on the inside surface and a hydrophilic yarn predominantly presented on the outside surface and wherein the tubular body is of a knitted construction comprising a hydrophobic yarn predominantly presented on an inside surface corresponding to the skin facing surface of the turned welt and an outer surface corresponding to the non-skin facing surface of the turned welt; and managing moisture transport from the skin facing surface of the turned welt to the non-skin facing surface.

DETAILED DESCRIPTION

Figure 1:
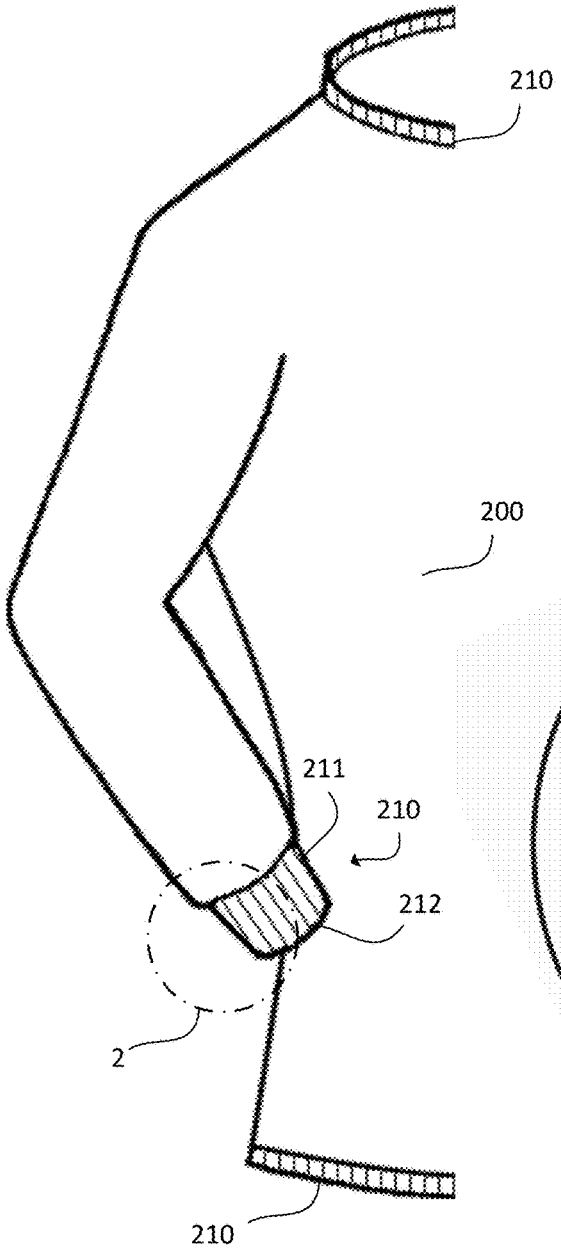
FIG. 1 depicts a perspective view of a cuff or collar with an exemplary turned welt construct in accordance with the present disclosure.

The present disclosure provides a technical solution to the technical problem disclosed above in the Background section. A turned welt construct is provided which maintains the hydrophobic yarn presentation to the skin of the wearer and avoids the accumulation of moisture and the uncomfortable sensation of wetness at the distal end of the cuff of an article of clothing. Moreover, the turned welt construct provided here with provides for the presentation of metal-containing yarn for providing the various functional benefits such as antimicrobial functionality, etc.

As used herein, the phrase "single yarn" is intended to mean that the same yarn from a single feed forms a course or wale. The single yarn can be a single-ply or multi-ply yarn or a group of yarns, for example, the singularly fed yarn can include plural yarns being provided as one to the needles.

As used herein the phrases "metal-containing fiber," "metal-containing single yarn" and "metal-containing yarn" are inclusive of fibers/yarns coated with metal, metal oxides, and/or metal salts impregnated with metal, metal oxides, and/or metal salts or containing particles of metal, metal oxides, and metal salts dispersed therein. Metal-containing fiber/yarn, as used herein, is inclusive of copper, copper oxide, and copper salt containing fiber/yarn and silver, silver oxide, and silver salt containing fiber/yarn. Copper containing fiber/yarn is inclusive of (micro) copper filaments with one or more of Cu+, Cu++, Cu+++ ions, zinc, zinc oxide, and/or zinc ions. Copper containing fiber/yarn is inclusive of combined Cu+/Cu+++ ions, e.g., essentially no Cu++ ions.

As used herein, the term "tubular" encompasses a tube shape, e.g., a hollow, elongated body or part with an internal diameter, an external diameter, and a length, including an elongated body or part with constant or fixed internal and external diameters along its length. Tubular encompasses an elongated body or part with variable internal and external diameters along its length, where the ratio of the internal and external diameters are substantially constant along the length or where the ratio of the internal and external diameters vary along the length. With regard to a knitted tubular body, it is understood that variations in yarn and fiber thicknesses, among other variables during the knitting operation, can provide for slight variations in the internal diameter and external diameter along the length of the elongated body or part, such that the terms "constant or fixed" are understood to encompass such variation. Likewise, it is understood that variations in variables during the knitting operation can provide for deliberate variations in the internal diameter and external diameter along the length of the elongated body or part, either in a fixed ratio of such diameters or with variation in the ratios of such diameters so as to accommodate the tubular body to accept and/or receive cuff or collars of various dimensions.

Used herein, the phrases "inner surface" and "skin facing surface," with reference to the turned welt of the knitted tubular body, are used interchangeably and refer to the surface(s) of the turned welt of the tubular body in direct contact with or facing the skin when the article of clothing is worn in a customary manner. Likewise, as used herein, the phrases "inner section," "inner portion," "skin facing portion," and "skin facing section," with reference to the turned welt of the knitted tubular body, are used interchangeably.

As used herein, the phrases "outer surface" and "outer portion" with reference to the turned welt of the knitted tubular body encompass a "non-skin facing surface." As used herein, each of the phrases "non-skin facing surface," "non-skin facing section," and "non-skin facing portion" are used interchangeably with reference to the turned welt of the knitted tubular body.

A cuff or collar comprising a turned welt is provided for preventing adverse effects to a wearer's skin and/or to eliminate or reduce wetness of the cuff or collar in proximity to the wearer's skin during use of an article of clothing. In one example, the article the article of clothing has a cuff and/or collar or hem comprising at least one elastic yarn.

The cuff or collar comprises a tubular body with an opening therethrough for receiving an arm, leg, or neck, the tubular body beginning at a turned welt in surrounding relation to the opening, the turned welt comprising a circularly-knitted fabric integral with the tubular body, the turned welt of the tubular body comprising: a skin-facing surface comprising one or both of a hydrophobic yarn and metal-containing yarn; and wherein the one or more hydrophobic yarn and metal-containing yarn is maintained adjacent to the skin of the wearer throughout the turned welt. In another example, the metal-containing yarn portion maintains a skin facing surface relationship in the turned welt.

In another example, the metal-containing yarn portion maintains a skin facing surface relationship in the turned welt and a skin facing surface relationship remote from the turned welt, e.g., multiple courses along the tubular body.

In one example, the cuff or collar comprises a tubular body that has a defined turned welt, with the turned welt section having a section being knit from at least two yarns or at least 3 yarns. In one example, the tubular body knit to form the cuff or collar that has a portion of its length and/or width formed from a yarn comprising one or more "functional" fibers designed to enhance particular performance characteristics of the cuff or collar during use, e.g., for an athletic activity, including, but not limited to enhanced wicking, antimicrobial resistance, moisture absorption, or thermal regulating functionality. In one example, the at least one yarn comprising one or more functional fibers comprises a metal-containing yarn. In another example, the metal-containing yarn is a copper metal, copper oxide, and/or copper salt containing yarn. It is understood that the yarn can be comprised of one or more natural or synthetic functional fibers, for example, natural or synthetic fibers that comprise metal, metal oxide, and/or metal salt such as copper, copper oxide, copper salt, silver, silver oxide, or silver salt. Natural or synthetic functional fibers that comprise metal, metal oxide and/or metal salt include metal-impregnated or metal-infused fibers, for example.

In one example, a tubular body suitable for the manufacture of a cuff or collar is knit such that selected adjacent wales in one or more of the individual courses are knit from distinct yarns, for example, to form a design or discrete structure or pattern in at least a portion of the turned welt section so as to provide specific functionality for the cuff or collar. The design or discrete structure or pattern can be uniform or non-uniform across the length or width of the turned welt section and can be on only one or on both opposing skin-facing and non-skin facing surfaces. Specific functionality in at least a portion of the turned welt of the tubular body can extend through the entirety of the welt. Specific functionality in at least a portion of the turned welt of the tubular body is prevented from folding over in the turned welt of the tubular body as a result of the presently disclosed structural arrangement described herein.

In one example, a tubular body is knit to a length and/or diameter approximating the desired length and/or diameter for a cuff or collar, for example, of an article of athletic apparel. The desired length and diameter of the tubular body can be adjusted for different sized cuff or collars associated with different sized articles of clothing. Athletic clothing can include form-fitting, elastic or stretch athletic apparel with elastic or stretchable collars and cuffs configured to hold the collar or cuff in position about the neck or arm/leg when the article of clothing is in use, such as shirts, leggins, leotards, tights, and the like.

In one example the turned welt of the cuff or collar comprises a non-skin facing surface and a skin facing surface, where each of the non-skin facing surface and the skin-facing surface are knit from at least two yarns where at least one of the at least two yarns contains functional fiber. In one example, at least one of the at least two yarns contains functional fiber provide functionality such as wicking, absorbing, antimicrobial resistance, or insulating that results in the turned welt of the cuff or collar having improved performance properties. In another example, the turned welt of the cuff or collar is knit from at least three yarns where at least one of the at least three yarns contains functional fiber that improves performance capabilities and/or properties of the resultant cuff or collar, such as a yarns that provide wicking, absorbing, antimicrobial resistance, or insulating functionality.

In one example, the turned welt of the cuff or collar comprises a circularly-knitted fabric tubular body having a double-ply knitted construction beginning with a beginning cuff or collar welt.

In an example of the present disclosure described above, which comprises one or more yarns, each of the one or more yarns providing enhanced performance characteristics, the turned welt of the cuff or collar is specifically knit from a yarn containing functional fiber configured to contact skin and be capable of providing antimicrobial characteristics and/or moisture wicking capability to the cuff or collar while the opposed surface of the turned welt of the cuff or collar is formed from one or more yarns configured to absorb moisture, e.g., from sweat.

Examples of yarns having functional fibers includes yarns made from functional fibers having elasticity, moisture management, antimicrobial, and thermal regulation properties when used in making knitted articles.

For example, an example of a yarn having elastic functional fiber includes yarns of nylon and/or polyester fibers. An exemplary elastic yarn includes spandex, elastane, LYCRA, CREORA® and the like.

An example of a yarn having functional fiber includes one or more hydrophobic fibers. An exemplary hydrophobic fiber includes polypropylene. In another example, the hydrophobic fiber includes polypropylene having infused metal or a metal coating. In one example, a yarn having an antimicrobial functional fiber includes yarns comprising a metal-containing fiber. An exemplary metal-containing fiber includes copper-containing fiber such as those sold by Cupron Inc. (Richmond, Virginia).

For example, moisture wicking/absorbing yarns can be used in the production of the cuff or collar. Examples of yarns with moisture wicking/absorbing fibers include yarns comprising fibers of cotton and cotton blends, polyesters and nylons. Moisture wicking/absorbing yarns can be used, for example, to complement the aforementioned hydrophobic yarns of the cuff or collar.

An example of a yarn comprising a functional thermal regulating fiber is yarn sold under the trade names COOLMAX®, THERMOLITE® (The Lycra Company, Wilmington, DE). Other yarns may be used in combination with one or more of the elastic yarns, moisture wicking yarns, antimicrobial yarns, and thermal regulating yarns.

In one embodiment, the cuff or collar comprises a circularly-knitted fabric tubular body of a plurality of yarns including an elastic yarn formed in needle loops extending in circumferential courses and axial wales. The turned welt of each cuff or collar comprises a welt beginning course, a welt ending course, and a plurality of intervening courses, the welt beginning and ending courses being connected with one another by a set of connecting needle loops formed in selected spaced wales, e.g., every fourth wale, and the intervening courses comprising needle loops formed only in wales other than the selected spaced wales and in yarn floats across such wales. Other selected spaced wales can be used.

In one example, the main cuff or collar body includes at least one selected courses which have needle loops formed in every wale and, thus, the main cuff or collar body is of a greater diameter than the turned welt of the cuff or collar as a result of the absence of needle loops in the selected spaced wales of the welt's intervening courses, thereby forming the cuff or collar of a tapered configuration.

For example, in one example, the main cuff or collar body of the cuff or collar comprises a first annular region adjacent the turned welt having courses formed of alternating needle loops and yarn floats and courses formed entirely of successive needle loops appearing in every wale, and a second annular region adjacent the first annular region having courses formed of alternating needle loops and tuck stitches and courses formed entirely of successive needle loops appearing in every wale.

In one example, both S-twist and Z-twist fibers are used as one unit for one or more portions of the cuff or collar. In another example, a Z-twist fiber is used for backing or loading the dial jacks of the circular knitting machine. In yet another example, alternating and intervening courses of the circularly-knitted fabric tubular body with S-twist and Z-twist yarns are used so as to cooperatively provide a flattening effect on the fabric of the tubular body.

Alternatively, a ribbed texture on one or more of the skin facing or opposing sides of the cuff or collar are provided. A ribbed texture, for example, can be provided using a 1×1 tuck high selection with the elastomeric yarn feed, e.g., one needle up (elastomeric yarn in needle) and one needle down (no elastomeric yarn in needle) and repeating that pattern 360 degrees about the circular arrangement of needles. Other ribbing selections, as are known, can be chosen.

In one example, cuff or collar disclosed herein comprises yarn comprising functional fiber providing antimicrobial properties forming a major portion of the skin facing section of the cuff or collar. For example, where a functional yarn having antimicrobial functionality is used alone or in part to form the skin facing portion of the tubular body preventing or eliminating skin issues of the user during use. In another example, a yarn comprising functional hydrophobic fiber having antimicrobial functionality is used in combination with another yarn having a hydrophobic or super hydrophobic functionality for managing moisture from a wearer's skin and facilitating transport from the skin facing surface of the turned welt to at least a portion of the outer surface of the turned welt for evaporation, or for absorption by a hydrophilic yarn or moisture absorbing functional fiber (i.e., a cotton or cotton blend yarn). Other yarns with unique functional fiber characteristics can be used in combination with the above.

A method of producing a cuff or collar is provided, the method comprises knitting, using a patterning mechanism, a small diameter tubular body so as to integrally form a defined inside and outside portion of the tubular body by causing one or more individual courses to have adjacent wales knit from the two or more functional yarns.

Basically, the knitting of each cuff or collar comprises the steps of forming, on the circular knitting machine, an annular turned welt presenting a beginning cuff or collar welt, knitting integrally to the beginning welt an annular main cuff or collar central body of a single-ply knitted construction, and then discharging from the knitting machine a cuff or collar upon completion of the knitting. The end opposite the turned welt of the presently disclosed cuff or collar structure can be secured without removal of the tubular body from the circular knitting machine so as to prevent or eliminate unwinding of the yarn during use. In one example, the end opposite the turned welt of the cuff or collar is secured using a pattern mechanism coupled to the circular knitting machine prior to removal of the tubular body from the circular knitting machine.

Thus, in one example of the manufacture of the disclosed cuff or collar, a circular warp knitting machine (Cifra S.p.a., Italy) or a circular knitting machine such as a Santoni MECMOR™ or Lonati SM-DJ series circular knitting machine is used, while a cylinder of the circular knitting machine is in counter clockwise motion (s-direction), a second feed 1×1 needle selection is activated and a yarn finger is lowered so that needles take in a first yarn, e.g., an elastic yarn (also known as the "make-up") for 2 revolutions of the cylinder. With the main feed (the first feed) needles in clear high position and with alternate 1×1 needles selected (opposite the 1×1 needles on second feed), a yarn finger on main feed is lowered mid height so that needle hooks take the functional yarn in so as to start making stitches around the elastic yarn.

In one example, a small diameter circular knitting machine such as a sock or hosiery machine is used to knit a tubular fabric that ultimately becomes the presently disclosed cuff or collar. In one example, the knitted cuff or collar is formed on a circular knitting machine which may be of a single or multi-feed type commonly known within the knitting industry. Such knitting machines basically include a rotatable needle cylinder of a relatively small diameter with axial needle slots formed in spaced relation to one another about the outer circumferential surface of the cylinder. A plurality of latch-type knitting needles, each having a yarn receiving hook and a closable latch assembly, are reciprocally disposed within the axial cylinder slots.

In other examples, the circular knitting machine has a plurality of knitting stations at which yarn feeding fingers or other feeding instruments are positioned into and out of yarn feeding disposition adjacent the upper end of the needle cylinder's so as to feed one or more of the multiple yarns to the needles. In one example, a circular knitting machine having two, three or four knitting stations are used. The needles are operatively manipulated within their respective slots of the cylinder by stationary cams positioned adjacent the cylinder to engage and act on cam butts formed on the needles during the rotation of the needle cylinder. In one example, the circular knitting machine is operable to carry out the knitting of each cuff or collar beginning with a turned welt and continuing therefrom through the main cuff or collar body.

A patterning mechanism associated with the circular knitting machine is utilized during the knitting process to select which yarn from a plurality of yarns accessible by the knitting machine will be fed to each needle on the knitting cylinder during each course. The patterning mechanism is further configured to determine which of a plurality of yarns provided will be fed to each individual needle in a predetermined manner so as to form a predetermined pattern. An exemplary patterning mechanism is a control drum or similar control arrangement of conventional construction provided on the circular knitting machine for determining the necessary transitional changes in the machine operation to form each portion or pattern of the cuff or collar.

The needle and yarn manipulations carried out by the circular knitting machine serves to stitch the yarns fed to the needles at the various knitting stations into successive needle loops which extend in the resultant fabric in circumferentially-extending courses of needle loops and axially-extending wales of needle loops, for example, forming "ribbing" in the central body of the cuff or collar.

As best seen in FIGS. 1-5 and exemplary cuff or collar, hem or waistband 210, 310 is shown being predominantly of a circularly-knitted construction for economical conservation of materials, with an annular beginning welt 212, 312 integral with a central body 211, 311 respectively. In one example, each cuff or collar, hem or waistband 210, 310 is formed as a circularly-knitted fabric tubular body, having a main cuff or collar, hem or waistband central body 211, 311 entirely of a single-ply knitted construction integrally knitted at its outer end with single-ply turned welt 212, 312, respectively. In another example, each cuff or collar, hem or waistband 210, 310 is formed as a circularly-knitted fabric tubular body, having a main cuff or collar, hem or waistband central body 211, 311 entirely of a multi-ply knitted construction integrally knitted at its outer end with multi-ply turned welt 212, 312.

The central body 211 can be knit from whatever type of yarn the manufacturer desires to have form the outer visible cuff or collar surface In one example, the central body 211 is knit from a combination of hydrophobic yarns on the skin-facing surface of the central body 211 and hydrophilic yarns on the non-skin facing surface of the central body 211. In another example, the central body 211 is knit from a combination of hydrophobic yarns alone or in combination with metal-containing yarn, for example, a yarn comprising copper-containing fiber, such as is sold by Cupron Inc. (Richmond, Virginia) on the skin-facing surface of the central body 211, and hydrophilic yarns on the non-skin facing surface of the central body 211.

Figure 2:
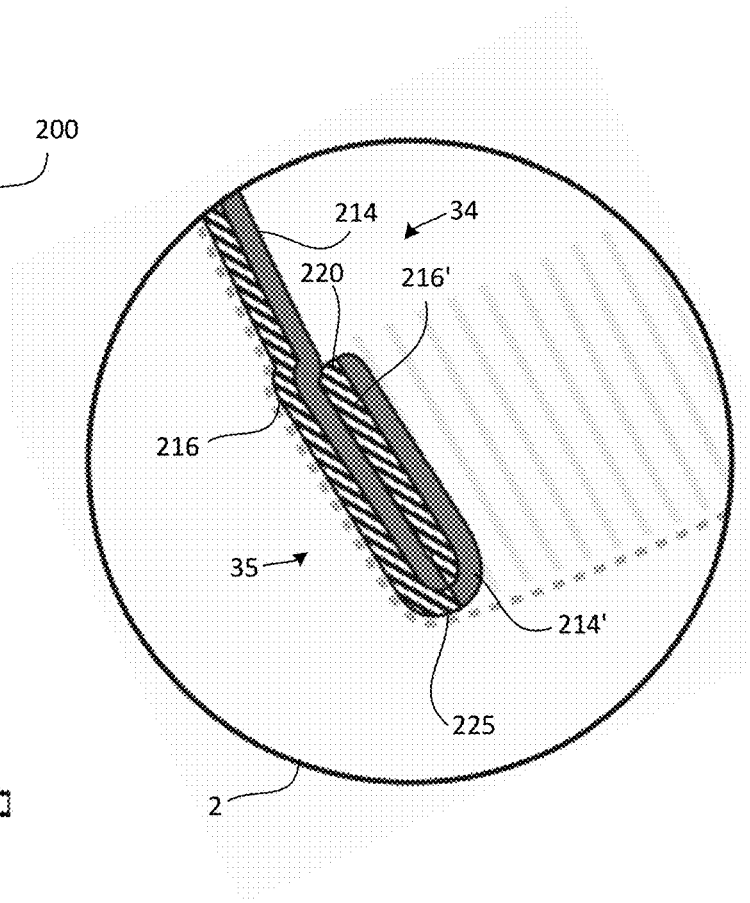
FIG. 2 depicts an enlarged view of a section 2 of the exemplary cuff or collar of FIG. 1, in accordance with the present disclosure.

As best seen in FIG. 2, the beginning turned welt 212 includes a continuous extent of circularly-knitted fabric with the opposite ends of the continuous extent of circularly-knitted fabric of the main cuff or collar central body 211 being integrally knitted with ending turn welt 212, spaced circumferentially about the cuff or collar 210.

The main cuff or collar central body 211 is immediately adjacent and directly knitted integrally with the turned welt 212 and generally follows the same stitch construction of the turned welt 212 for a relatively short axial extent of the cuff or collar, e.g., approximately one-half inch, and then can be configured to merge integrally into a predominant ribbed region of the main cuff or collar central body 211. In one example, the relatively short axial extent constitutes a lap.

In one example, yarn with functional fiber can form substantially the entire inner/skin-facing surface 34, whereas, yarn with a different functional fiber can form substantially the outer/non-skin-facing surface 35 of the central tubular body 211 and the turned welt 212. In one example, the longitudinal length of turn welt 212 is substantially less than the length of the central portion 211.

Thus, in one example, the central portion 211 is formed from at least one yarn with functional fiber as the inner/skin-facing surface 34, with outer/non-skin-facing surface 35 being formed from a yarn with different functional fibers. As a further alternative, the entire cuff or collar 212 could be knit from at least two yarns each with a functional fiber, or at least three yarns each with a functional fiber or combination thereof.

With reference to FIGS. 1 and 2 an exemplary turned welt 212 of the cuff 210 of article 200 is described. Tubular central body 211, presenting a predominantly hydrophobic and/or metal-containing skin facing surface and having predominantly hydrophilic yarn predominantly presenting as a non-skin facing surface, terminates at turned welt 212. Turned welt 212 presents a predominantly hydrophobic and/or metal-containing skin facing surface having predominantly hydrophilic yarn adjacent the opposite surface thereof, which in turn has a predominantly hydrophobic and/or metal-containing yarn adjacent thereto, which in turn has a predominantly hydrophilic yarn forming the outer non-skin facing surface of the turned welt 212.

Thus, an exemplary method of preparing turned welt 212 includes a circular knitting machine initially set up with one yarn feeding finger at each of the multiple knitting stations of the circular knitting machine equipped with an appropriate elastic (multi-) filament, alone or in combination with a hydrophilic yarn, e.g., polyester or nylon yarn, suitable for forming the main fabric structure (body yarn) of the cuff 210. In addition, a designated one of a plurality of knitting stations is set up with another of its yarn feeding fingers equipped with a metal-containing yarn to be fed to the needles simultaneously with the body yarn at such knitting station.

With the second feed needle selection switching to the same selection as the first feed, the dial cam is activated to extract the dial jacks in between the 1×1 needle selection so that the functional yarn now lays over the selected dial jacks and ties in to previous stitches/make-up for one revolution.

After the dial jacks are loaded with yarn, the dial cam is deactivated, the first feed needle selection changes to select all needles up clear high and the yarn finger selection on first feed changes from one finger to three, where one finger engages the metal-containing and/or hydrophobic yarn plaited towards the inside of the cylinder and the other finger engages the hydrophilic yarn plaited towards outside of the cylinder for a width of approximately ten needles, providing a lap. Then, the first feed finger comes out of needle selection.

A welt is made, e.g., corresponding to turned welt 212 as the dial jacks continue to hold on to the functional yarn as the cylinder continues in the s-direction for a number of revolutions providing "an inside welt" where hydrophobic yarn 214 is configured for presentation to the skin of a wearer of the article 200.

The process then diverts to formation of an outside of the welt with the first feed finger change and pattern activation. This pattern allows for providing hydrophilic yarn plaited towards inside of cylinder while having a hydrophobic/metal-containing yarn plaited towards outside of cylinder. The first feed finger change inserts backing yarns (spandex, hydrophilic yarn) and after the lap, the inside welt yarns come out of needle selection. The metal-containing yarn comes from 1 of 6 pattern feeds and ties into the first feed backing yarn, but is plaited to the outside of the backing side for presentation to the skin of the wearer. The outside welt revolutions closely match the inside welt revolutions so that the hydrophobic and/or metal-containing yarn is at the crest 225 of the welt 212.

While the skin side pattern continues until it is time to end the welt by extracting the dial jacks (as all needles are being selected) the metal-containing yarn that was on the dial jacks are knit in as the dial jacks are pulling back in, releasing the metal-containing yarn from the jacks and into the needles, thus forming the structure shown in FIG. 2 where the turned welt 212 comprises an integral structure, described from inside (skin facing) to outside (non-skin facing) of the turned welt as: predominantly hydrophobic yarn 214'/predominantly hydrophilic yarn 216'/predominantly hydrophobic yarn 214/predominantly hydrophilic yarn 216 that includes connecting stitches 220 integrally knitted and spaced circumferentially about the welt.

Figure 3:
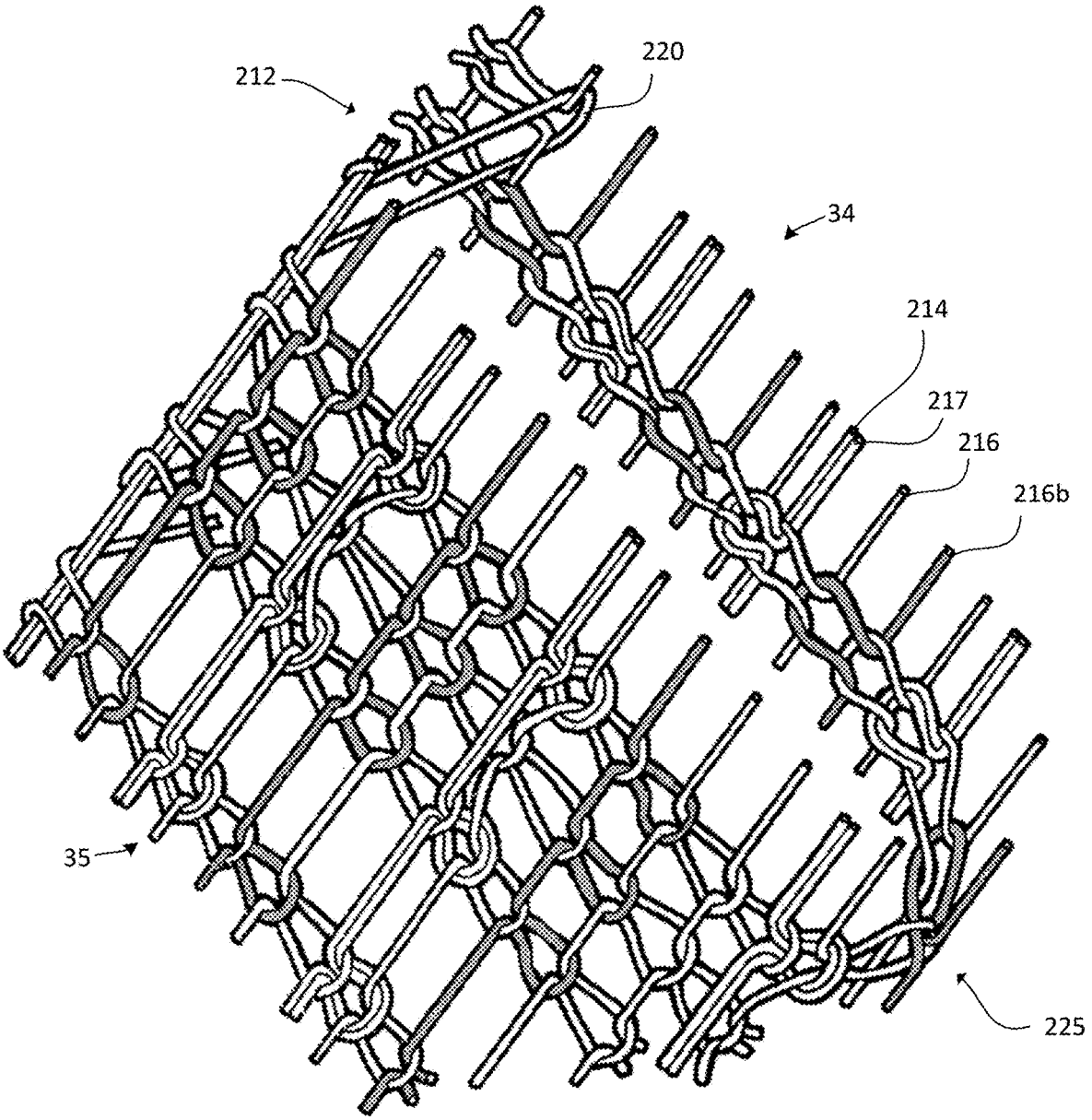
FIG. 3 depicts an further enlarged view of an exemplary knitting pattern of a turned welt with metal-containing yarn, in accordance with the present disclosure.

With reference to FIG. 3, which depicts an enlarged surface view of an exemplary knitting pattern for the turned welt 212, but comprising metal-containing yarn courses **216*b* and alternating courses of hydrophobic yarns 214, elastomeric yarns 217, and hydrophilic yarns 216 as well as connecting stitches 220**. Other arrangements of courses amongst the hydrophobic, metal-containing, elastomeric, and hydrophilic yarns are possible.

Figure 4:
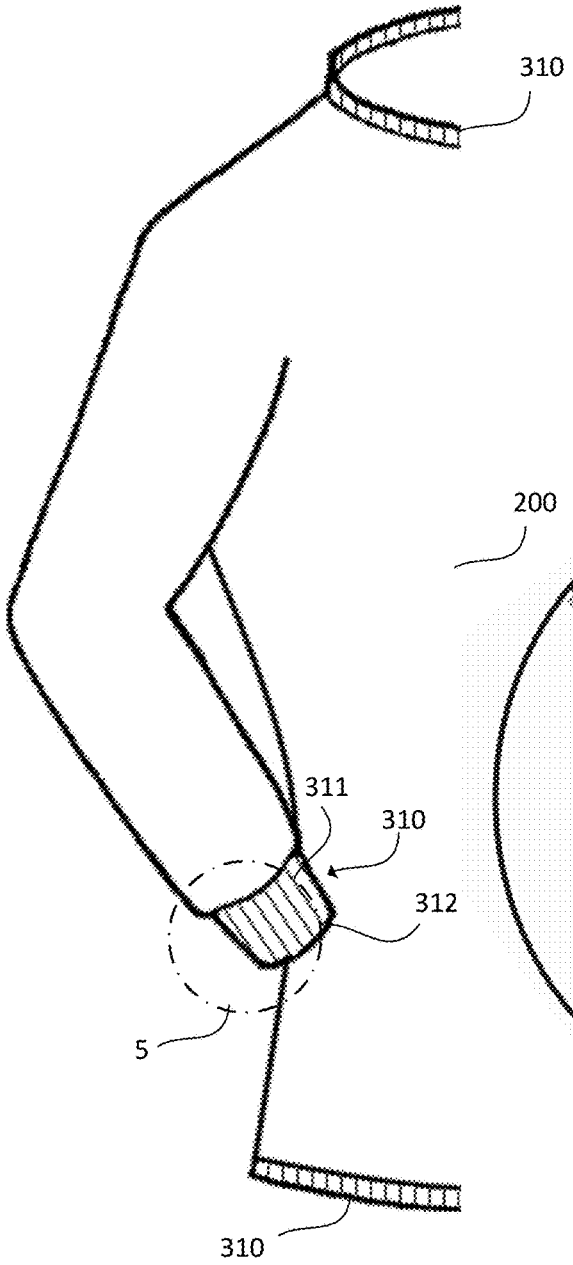
FIG. 4 depicts a perspective view of an cuff or collar with an exemplary turned welt construct in accordance with the present disclosure.
Figure 5:
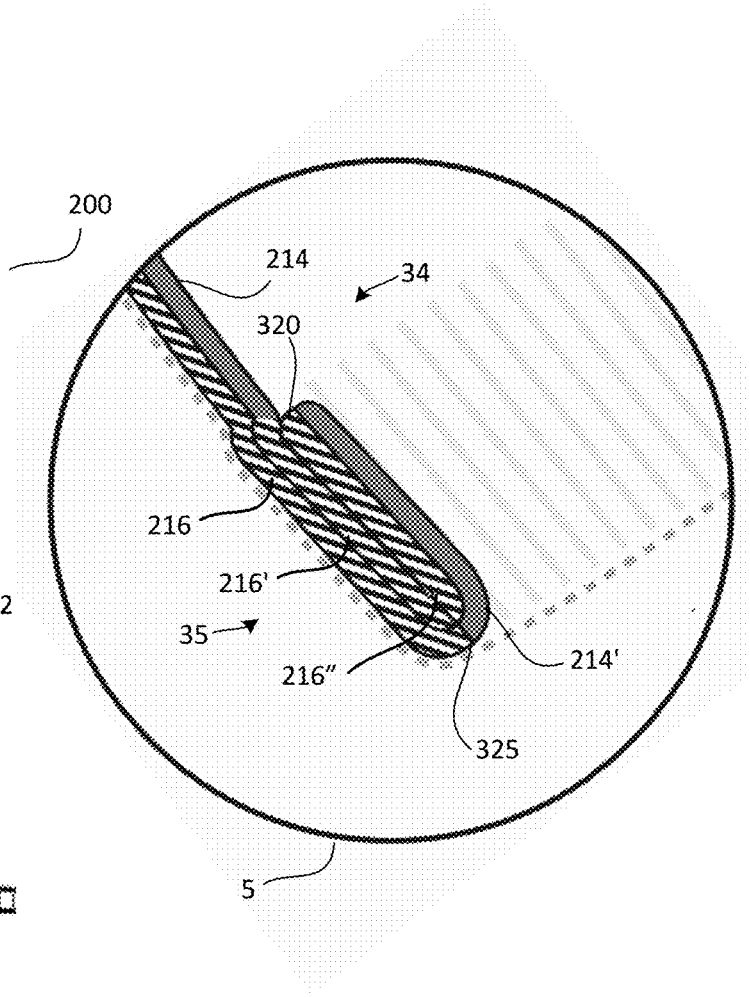
FIG. 5 depicts an enlarged view of a section 5 of the exemplary cuff or collar of FIG. 4, in accordance with the present disclosure.

With reference to FIGS. 4 and 5 an exemplary turned welt 312 is depicted. Tubular central body 311, presenting a predominantly hydrophobic and/or metal-containing skin facing surface and having predominantly hydrophilic yarn predominantly presenting as a non-skin facing surface, terminates at turned welt 312. Turned welt 312 presents a predominantly hydrophobic and/or metal-containing skin facing surface having predominantly hydrophilic yarn adjacent the opposite surface thereof, such hydrophilic yarn continuing and forming the outer non-skin facing surface of the turned welt 312. Turned welt 312 can be prepared using circular knitting machine that is initially set up with one yarn feeding finger at each of the multiple knitting stations of the circular knitting machine equipped with an appropriate elastic (multi-) filament, e.g., polyester or nylon yarn, suitable for forming the main fabric structure (body yarn) of the cuff or collar 310. In addition, a designated one of the knitting stations is set up with another of its yarn feeding fingers equipped with a metal-containing yarn to be fed to the needles simultaneously with the body yarn at such knitting station.

With the second feed needle selection switching to the same selection as the first feed, the dial cam is activated to extract the dial jacks in between the 1×1 needle selection so that the functional yarn now lays over the selected dial jacks and ties in to previous stiches/make-up for one revolution.

After the dial jacks are loaded with yarn, the dial cam is deactivated, the first feed needle selection changes to select all needles up clear high and the yarn finger selection on first feed changes from one finger to 3, where one finger engages the metal-containing yarn/hydrophobic yarn 214 plaited towards the inside of the cylinder and the remaining fingers engages the hydrophilic yarn 216" plaited towards outside of the cylinder for a width of approximately ten needles, providing a lap. Then, the original first feed finger comes out of needle selection.

A welt is made, e.g., corresponding to welt 312, as the dial jacks continue to hold on to the functional yarn as the cylinder continues in the s-direction for a number of revolutions providing "an inside welt."

The process then diverts to formation of an outside of the welt with the first feed finger change and pattern activation. This pattern allows for providing hydrophilic yarn 216' plaited towards inside of the cylinder while having another hydrophilic yarn 216 inserted by approximately 10 needles so as to create a lap, and removing the metal-containing yarn 214 from the needles. The outside welt revolutions closely match the inside welt revolutions so that the metal-containing yarn is at the crest 325 of the welt 312.

Figure 6:
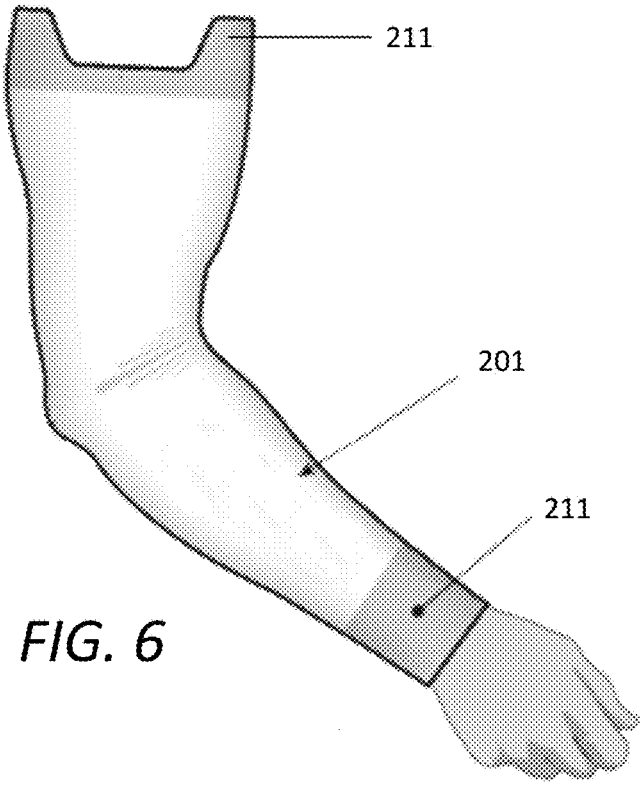
FIG. 6 depicts a perspective view of an arm sleeve with an exemplary turned welt construct in accordance with the present disclosure.

To end the welt, the dial jacks are extracted (as all needles are being selected is yarn that was on the dial jacks that are knit in as the dial jacks are pulled back in), releasing the yarn from the jacks and into the needles, with the metal-containing yarn reinserted and plaiting towards the outside of the cylinder for approximately a 10 needle lap with the second hydrophilic fiber coming out of the needles, thus forming the structure shown in FIG. 6, where the turned welt 312 comprises an integral structure, described from inside (skin facing) to outside (non-skin facing) as: predominantly hydrophobic yarn 214'/predominantly hydrophilic yarn 216"/predominantly hydrophilic yarn 216'/predominantly hydrophilic yarn 216 that includes connecting stitches 320 integrally knitted and spaced circumferentially about the welt.

In one example, the second feed yarn used to fabricate the turned welt 212,312 of the present disclosure is spandex or similar elastic yarn that the circular knitting machine has been programmed in such a way that the second feed yarn feeder runs very slow to tighten or tension the end of the welt in the first welt and gradually loosens tension through about mid-way of the tubular body of the chins-sock and then to begin gradually tighten or tension subsequent to formation of the second welt so as to approximately match the yarn tension of the first welt.

In one example, a number of wales forming a skin-contacting side 34 of the cuff, or collar, hem, or waistband, (i.e. the wales along a portion of the tubular circumference of the cuff or collar) can be knit from a yarn with functional fiber such as those described above, while a non-skin-contacting side 35 can be knit from a different type or types of yarns, in order that skin-contacting surface of the finished cuff or collar will have enhanced performance characteristics, such as one or more of increased antimicrobial, wicking, or moisture absorbing capabilities. Alternatively, substantially all of the non-skin-contacting side 35 or the entire non-skin-contacting side 35 could also be knit from yarns having one or more functional fibers, either the same functional fibers or a combination of different functional fibers.

In one example, the hydrophobic inner yarn 214 of the cuff 310 is polypropylene from 50% to 70% by weight and the hydrophilic outer yarn 216 is polyester/nylon/acrylic/wool/cotton blend from 30% to 50% by weight, and spandex/Elastane (stretch fibers) positioned between the outer yarn 216 and inner yarn 214 is used from 10% to 30% by weight. The turned welt 312 of cuff 310 is polypropylene from 20% to 40% by weight and the hydrophilic layer(s) 216 is polyester/nylon/acrylic/wool/cotton blend from 40% to 70% by weight, and spandex/Elastane (stretch fibers) positioned between the outer yarn 216 and inner yarn 214 is used from 7% to 17% by weight.

Figure 7:
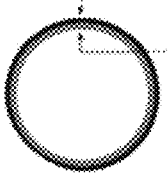
FIG. 7 depicts a section view of an exemplary turned welt construct in accordance with the present disclosure.
Figure 8:
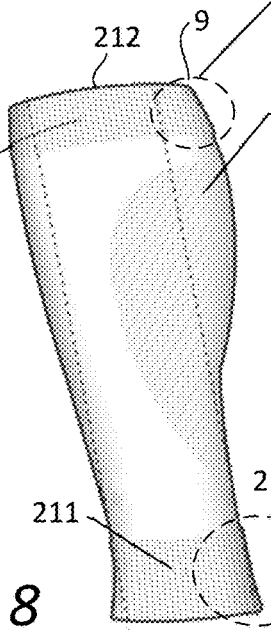
FIG. 8 depicts a perspective view of a leg/calf sleeve with an exemplary turned welt construct in accordance with the present disclosure.
Figure 9:
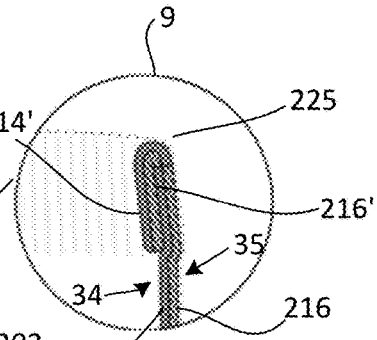
FIG. 9 depicts an enlarged view of section 9 of the exemplary turned welt construct of FIG. 8.
Figure 10:
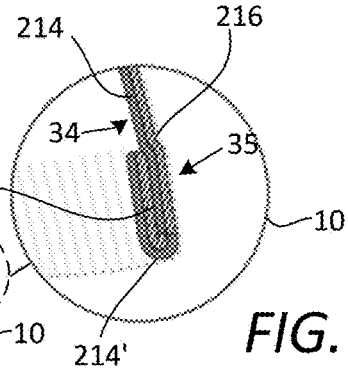
FIG. 10 depicts an enlarged view of section 10 of the exemplary turned welt construct of FIG. 8.

With reference now to FIGS. 6-10, the presently disclosed knitted turned welt 212 is shown in use with an arm sleeve 201 and thigh sleeve 202, where FIG. 7 represents a section view of the inner/outer diameter of either sleeve. The knitted turned welt 212 can be provided at both ends of the tubular sleeves, as shown. In one example, the hydrophobic inner yarn 214 of sleeve 201, 202 is polypropylene from 50% to 70% by weight and the hydrophilic outer yarn 216 is a polyester/nylon/acrylic/wool/cotton blend from 30% to 50% by weight with spandex/elastane (stretch fibers) positioned between the outer yarn 216 and yarn layer 214 from 10% to 30% by weight. The turned welts 212 of sleeves 201, 202 are polypropylene from 50% to 70% by weight and the hydrophilic outer yarn 216 is polyester/nylon/acrylic/wool/cotton blend from 20% to 30% by weight, and spandex/Elastane (stretch fibers) positioned between the outer yarn 216 and inner yarn 214 is used from 10% to 20% by weight.

Advantageously, the knitted turned welt 212, 312 of cuff or collar 210, 310 produced by the present disclosure in the manner above-described uniquely enable the methodology by which cuff or collars are fabricated to minimize or reduce the collection of moisture on the skin facing surface of the distal end of the cuff or collar directly adjacent the turned welt thereof.

I claim:

1. A cuff, a collar, a welt, a hem, or a waistband comprising a tubular body having an opening; and a turned welt being in surrounding relation to the opening, the turned welt integral with the tubular body; the turned welt having a skin-facing surface configured for engagement with skin of a wearer and an outside non-skin facing surface;

wherein the turned welt is of a knitted construction comprising a hydrophobic yarn presented on the skin-facing surface and a hydrophilic yarn presented on the outside non-skin facing surface, with at least one course of hydrophilic yarn between the skin-facing surface and the non-skin facing surface;

wherein the tubular body is of a knitted construction comprising the hydrophobic yarn of the skin-facing surface of the turned welt and the hydrophilic yarn of the outside non-skin facing surface of the turned welt.

2. The cuff, the collar, the welt, the hem, or the waistband according to claim 1, wherein the turned welt comprises yarn comprising metal-containing fiber comprising copper, zinc, or silver metal, oxides, or salts.

3. The cuff, the collar, the welt, the hem, or the waistband according to claim 1, wherein the turned welt includes an elastic make up yarn.

4. The cuff, the collar, the welt, the hem, or the waistband according to claim 1, wherein the skin-facing surface is integral with and adjacent to a moisture absorbing yarn adjacent the outer surface.

5. The cuff, the collar, the welt, the hem, or the waistband according to claim 1, wherein the skin-facing surface of the turned welt comprises the hydrophobic yarn integral with a moisture absorbing yarn and/or moisture wicking yarn, where the moisture absorbing yarn and/or moisture wicking yarn presents at the outside non-skin facing surface of the turned welt.

6. The cuff, the collar, the welt, the hem, or the waistband according to claim 1, wherein a skin-facing surface of the tubular body comprises the hydrophobic yarn and the outside non-skin facing surface comprises a moisture absorbing yarn.

7. The cuff, the collar, the welt, the hem, or the waistband according to claim 1, wherein the skin-facing surface of the turned welt presents yarn with metal-containing fiber.

8. A method of managing moisture transport in an article of clothing, the method comprising:

providing the article comprising the collar, the welt, the hem, the waistband, or the cuff with the turned welt as defined in claim 1; and managing the moisture transport from the skin-facing surface of the turned welt to the outside non-skin facing surface.

9. The method according claim 8, wherein the turned welt comprises yarn comprising metal-containing fiber comprising copper, zinc, or silver metal, oxides, or salts.

10. The method according claim 8, wherein the turned welt includes an elastic make up yarn.

11. The method according claim 8, wherein the skin-facing surface is integral with and adjacent to a moisture absorbing yarn adjacent the outside non-skin-facing surface.

12. The method according claim 8, wherein the skin-facing surface of the turned welt comprises the hydrophobic yarn integral with a moisture absorbing yarn and/or moisture wicking yarn, where the moisture absorbing yarn and/or moisture wicking yarn presents at the outside non-skin facing surface of the turned welt.

13. The method according claim 8, wherein a skin-facing surface of the tubular body comprises the hydrophobic yarn and the outside non-skin facing surface comprises a moisture absorbing yarn.

14. The method according claim 8, wherein the skin-contacting surface of the turned welt presents yarn with metal-containing fiber.

* * * * *